US010475391B2

(12) United States Patent
Lu et al.

(10) Patent No.: US 10,475,391 B2
(45) Date of Patent: Nov. 12, 2019

(54) TFT PIXEL THRESHOLD VOLTAGE COMPENSATION CIRCUIT WITH DATA VOLTAGE APPLIED AT LIGHT-EMITTING DEVICE

(71) Applicant: Sharp Kabushiki Kaisha, Osaka (JP)

(72) Inventors: Tong Lu, Oxford (GB); Michael James Brownlow, Oxford (GB); Tim Michael Smeeton, Oxford (GB); Naoki Ueda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 31 days.

(21) Appl. No.: 15/935,123

(22) Filed: Mar. 26, 2018

(65) Prior Publication Data

US 2019/0295473 A1 Sep. 26, 2019

(51) Int. Cl.

| | |
|---|---|
| ***G09G 3/36*** | (2006.01) |
| ***G09G 3/30*** | (2006.01) |
| ***G09G 3/3291*** | (2016.01) |
| ***G09G 3/3266*** | (2016.01) |

(52) U.S. Cl.

CPC ..... *G09G 3/3291* (2013.01); *G09G 3/3266* (2013.01); *G09G 2300/0852* (2013.01); *G09G 2310/066* (2013.01); *G09G 2320/0238* (2013.01)

(58) Field of Classification Search

CPC ... G09G 3/36; G09G 5/00; G09G 3/30; G11C 19/00; G02F 1/1345; G06F 3/038

See application file for complete search history.

(56) References Cited

U.S. PATENT DOCUMENTS

| | | | |
|---|---|---|---|
| 7,414,599 | B2 | 8/2008 | Chung et al. |
| 7,936,322 | B2 | 5/2011 | Chung et al. |
| 8,237,637 | B2 | 8/2012 | Chung |

(Continued)

*Primary Examiner* — Pegeman Karimi

(74) *Attorney, Agent, or Firm* — Renner, Otto, Boisselle & Sklar, LLP

(57) ABSTRACT

A pixel circuit for a display device includes a drive transistor configured to control an amount of current to a light-emitting device depending upon a voltage applied to a gate of the drive transistor; a second transistor connected to the gate of the drive transistor and a second terminal of the drive transistor, such that when the second transistor is in an on state the drive transistor becomes diode-connected such that the gate and the second terminal of the drive transistor are connected through the second transistor; a light-emitting device that is connected at a first node to a third terminal of the drive transistor and at a second node to a first voltage supply; a third transistor connected to the first node of the light-emitting device, which connects a data voltage to the first node of the light-emitting device; a fourth transistor that is connected between the second terminal of the drive transistor and a second voltage supply; and at least one capacitor having a first plate that is connected to the gate of the drive transistor and a second plate that is connectable to a reference signal. The pixel circuit is operable during a phase preceding the emission phase including applying a data voltage to the first node of the light-emitting device and the third terminal of the drive transistor, the data voltage being set so that a voltage across the light-emitting device is lower than a threshold voltage of the light emitting device.

20 Claims, 10 Drawing Sheets

(56) References Cited

U.S. PATENT DOCUMENTS

| | | | | |
|---|---|---|---|---|
| 8,305,303 | B2 * | 11/2012 | Nam | G09G 3/3233 315/169.3 |
| 8,314,788 | B2 | 11/2012 | Choi | |
| 9,337,439 | B2 | 5/2016 | Kwon | |
| 9,489,894 | B2 | 11/2016 | Yin et al. | |
| 9,691,328 | B2 * | 6/2017 | Qing | G09G 3/3258 |
| 9,773,451 | B2 * | 9/2017 | Wu | G09G 3/3258 |
| 2012/0306843 | A1 * | 12/2012 | Wang | G09G 3/3258 345/212 |
| 2013/0265215 | A1 * | 10/2013 | Liao | G09G 3/3233 345/82 |
| 2018/0190194 | A1 * | 7/2018 | Zhu | H01L 27/12 |

* cited by examiner

TFT PIXEL THRESHOLD VOLTAGE COMPENSATION CIRCUIT WITH DATA VOLTAGE APPLIED AT LIGHT-EMITTING DEVICE

TECHNICAL FIELD

The present invention relates to design and operation of electronic circuits for delivering electrical current to an element in a display device, such as for example to an organic light-emitting diode (OLED) in the pixel of an active matrix OLED (AMOLED) display device.

BACKGROUND ART

Organic light-emitting diodes (OLED) generate light by re-combination of electrons and holes, and emit light when a bias is applied between the anode and cathode such that an electrical current passes between them. The brightness of the light is related to the amount of the current. If there is no current, there will be no light emission, so OLED technology is a type of technology capable of absolute blacks and achieving almost "infinite" contrast ratio between pixels when used in display applications.

Several approaches are taught in the prior art for pixel thin film transistor (TFT) circuits to deliver current to an element of a display device, such as for example an organic light-emitting diode (OLED), through a drive transistor. In one example, an input signal, such as a high "SCAN" signal, is employed to switch transistors in the circuit to permit a data voltage, VDAT, to be stored at a storage capacitor during a programming phase. When the SCAN signal is low and isolated from the circuit by a switch transistor closing, the VDAT voltage is retained by the capacitor and this voltage is applied to a gate of a drive transistor. With the drive transistor having a threshold voltage $V_{TH}$, the amount of current to the OLED is related to the voltage on the gate of the drive transistor by:

$$I_{OLED} = \frac{\beta}{2}(V_{DAT} - V_{OLED} - V_{TH})^2$$

TFT device characteristics, especially the TFT threshold voltage $V_{TH}$, may vary, for example due to manufacture processes or stress and aging of the TFT device during the operation. With the same VDAT voltage, the amount of current delivered by the driving TFT could vary by a large amount due to such threshold voltage variations. Therefore, pixels in a display may not exhibit uniform brightness for a given VDAT value.

Conventionally, therefore, OLED pixel circuits have high tolerance ranges to variations in threshold voltage and/or carrier mobility of the drive transistor by employing circuits that compensate for mismatch in the properties of the drive transistors. For example, an approach is described in U.S. Pat. No. 7,414,599 (Chung et al., issued Aug. 19, 2008), which describes a circuit in which the drive TFT is configured to be a diode-connected device during a programming period, and a data voltage is applied to the source of the drive transistor.

With such circuit configuration, however, the anode of the OLED is not reset during initialization and programming phases. Rather, there will be residual voltage at the OLED anode. When emission starts and the emission current flows through the OLED during the emission phase, the OLED will need some time to refresh the data voltage at the anode. A first problem with this is that it may affect the true black state. If the previous frame data voltage corresponds to a white grayscale and the current frame data voltage corresponds to a black grayscale, there will be some light emission due to the residual voltage at the beginning of the emission phase. The true black state will be compromised. A second problem is memory effects from the previous frame data. If the programmed current is a low current, it could take a significant time to refresh the anode to the programmed value. During the refresh period, the light emission could vary due to the previous residual data at the anode of the OLED, which means the same programmed data could have different light emission as affected by the previous frame data.

Another approach is described in U.S. Pat. No. 8,314,788 (Choi, issued Nov. 12, 2012). In such circuit, the diode connection voltage for a drive transistor is pulled down by changing the voltage level at the top plate of the storage capacitor. There are significant drawbacks with such configuration and method. First, when pulling down the gate voltage of the drive transistor, the diode connected drive transistor is forward biased, and there could be a large instant current to the OLED. This may cause an instance of high luminance light, which would prevent a pixel from ever having a true black state. Second, the anode of the OLED and the gate voltage of the drive transistor would hold the voltage from the previous frame. As there is no initialization or reset scheme, the voltage from the previous frame could affect the programmed voltage for current frame. Therefore, the current to the OLED during a frame may be affected by the state in the previous frame, as well as by the applied data.

Other approaches to address the above problems have proven deficient. U.S. Pat. No. 7,936,322 (Chung et al., issued May 3, 2011) describes a scheme to reduce the number of transistors to five by overlapping scan and emission control signals. This approach, however, could cause a leakage current during the programming phase, which may affect the blackness in low current operations. U.S. Pat. No. 8,237,637 (Chung, issued Aug. 7, 2012) describes a scheme to improve the blackness and remove the memory effects on the anode of the OLED by adding one more transistors between the initial voltage and the anode. This configuration, however, increases the transistor number to seven in the circuit, which will lower the yield and be difficult to implement in high resolution applications requiring a small geometry. U.S. Pat. No. 9,337,439B2 (Kwon, issued May 10, 2016) describes a scheme to improve the blackness by using previous data, but the number of transistors is still high and the residual voltage at the anode of the OLED could still cause some light leakage in low current. U.S. Pat. No. 9,489,894B2 (Yin et al.) describes a scheme to use ELVDD as an initial signal, which reduces the signal line by one. This approach, however, still has the same number of transistors as U.S. Pat. No. 7,414,599, and the same residual memory effects at the anode of the OLED.

SUMMARY OF INVENTION

The present invention relates to pixel circuits that are capable of compensating the threshold voltage variations of the drive transistor with fewer transistors than in conventional configurations, with additionally removing the possible memory effects associated with the OLED device and drive transistor from the previous frame. The described circuit configurations, therefore, improve the capability of a pixel to emit very little or no light and therefore have a true black state.

A pixel circuit for delivering a current to an OLED incorporates a data voltage (VDAT) applied at a terminal of the OLED, such as at the anode of the OLED, during a programming phase. VDAT designates the required current for the OLED during a subsequent emission phase, which corresponds to the luminance of the pixel for the frame as established for the programming phase and emission phase.

The voltage range of VDAT is either:

i) in all cases less than the threshold voltage of the OLED device (i.e. the voltage applied to the anode of the OLED which would cause a significant current to flow through the OLED, or significant light emission from the OLED);

or ii) Below the voltage which would be applied to the OLED anode during the subsequent emission phase, and corresponding to the current (or luminance) of the OLED which is designated by the VDAT value.

As a consequence, there will be no light emission from the OLED during the programming phase, or the luminance from the OLED during the programming phase is less than the designed luminance during the subsequent emission phase. Therefore, the minimum luminance from the pixel is low, and the true darkness will be improved.

When VDAT is applied at the anode of the OLED during the programming phase, the voltage at the terminal of the OLED is reset or initialized to VDAT. Memory effects associated with the OLED, whereby the voltage at the anode of the OLED from the previous frame affects the circuit operation during the present frame, are therefore reduced or eliminated. In other embodiments, the VDAT may be applied to the cathode of the OLED during the programming phase, with comparable effect to reduce or eliminate memory effects.

In addition, a voltage at the gate of the drive transistor is reset during an initialization phase. In this manner, memory effects associated with the drive transistor also are reduced or eliminated.

Embodiments of the present invention have advantages over conventional configurations. Such advantages include, for example, providing effective threshold voltage compensation, reduction or elimination of memory effects, true black improvements and efficient data programming. Exemplary embodiments utilize only four transistors and as few as one capacitor for the above functions.

An aspect of the invention is a pixel circuit for a display device that is operable an initialization state, in a combined programming and compensation phase, and in an emission phase. In exemplary embodiments, the pixel circuit includes: a drive transistor configured to control an amount of current to a light-emitting device depending upon a voltage applied to a gate of the drive transistor; a second transistor connected to the gate of the drive transistor and a second terminal of the drive transistor, such that when the second transistor is in an on state the drive transistor becomes diode-connected such that the gate and the second terminal of the drive transistor are connected through the second transistor; a light-emitting device that is connected at a first node to a third terminal of the drive transistor and at a second node to a first voltage supply; a third transistor connected to the first node of the light-emitting device, which connects a data voltage to the first node of the light-emitting device; a fourth transistor that is connected between the second terminal of the drive transistor and a second voltage supply; and at least one capacitor having a first plate that is connected to the gate of the drive transistor and a second plate that is connectable to a reference signal.

Another aspect of the invention is a method of operating a pixel circuit by which the pixel circuit is operable during a phase preceding the emission phase, during which the drive transistor is diode connected. The phase preceding the emission phase includes applying a data voltage to the first node of the light-emitting device and the third terminal of the drive transistor, the data voltage being set so that a voltage across the light-emitting device is lower than a threshold voltage of the light emitting device. The operating method may include applying a reference signal to the second plate of the capacitor, wherein the reference signal is connected to a reference power supply; changing the reference signal to a level for compensation for variations of a threshold voltage of the drive transistor; and during a subsequent emission phase, adjusting the reference signal to change the gate voltage of the drive transistor to the operational voltage range, in which the drive transistor controls the amount of current to the light-emitting device.

The operating method may include performing an initialization phase, performing a combined programming and compensation phase; and performing the emission phase. In exemplary embodiments, each phase may include the following. During the initialization phase, memory effects from previous frames are reduced by performing the steps of: keeping the fourth transistor in the on state and keeping the second and third transistors in an off state; inputting the reference signal, wherein the reference signal during the initialization phase is set at a level corresponding to the drive transistor being in an off state; switching the second and third transistors from the off state to the on state, wherein the drive transistor becomes diode-connected through the second transistor and thereby connecting the gate of the drive transistor to the second voltage; and applying a data voltage VDAT to the first terminal of the light-emitting device, VDAT being set so that the voltage across the light-emitting device is lower than a threshold voltage. During the combined programming and compensation phase, the voltage threshold of the drive transistor is at least partially compensated and data is programmed by the steps of: placing the fourth transistor in an off state; changing the reference signal to a level for compensation for variations of a threshold voltage of the drive transistor; and updating VDAT to a data voltage for a current pixel. During the emission phase, light output is controlled by performing the steps of: placing the second and third transistors in an off state; adjusting the reference signal to change the gate voltage of the drive transistor to the operational voltage range, in which the drive transistor controls the amount of current to the light-emitting device; placing the fourth transistor in the on state to connect the second power supply to the drive transistor; and controlling an amount of current to the light-emitting device depending upon a voltage applied to a gate of a drive transistor.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF EMBODIMENTS

Figure 1:
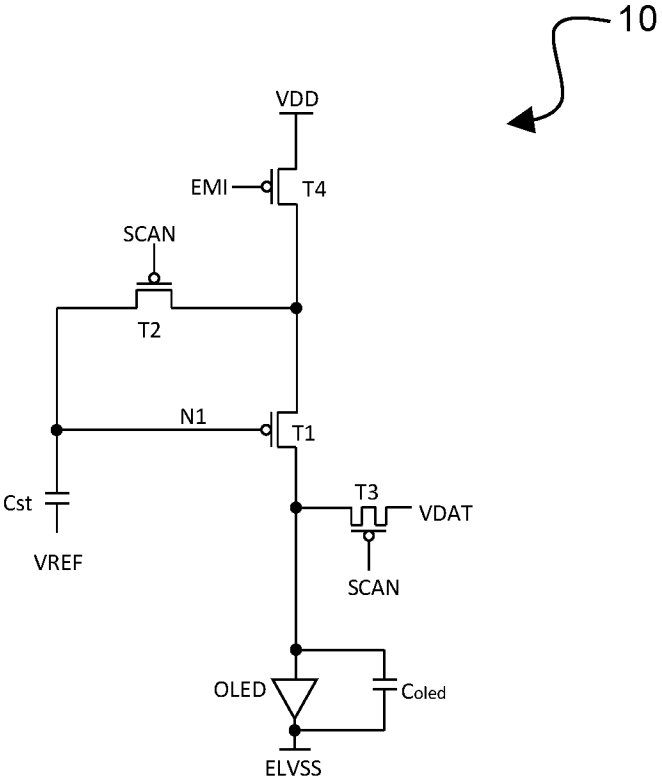
FIG. 1 is a drawing depicting a first circuit configuration in accordance with embodiments of the present invention.

Embodiments of the present invention will now be described with reference to the drawings, wherein like reference numerals are used to refer to like elements throughout. It will be understood that the figures are not necessarily to scale.

Figure 2:
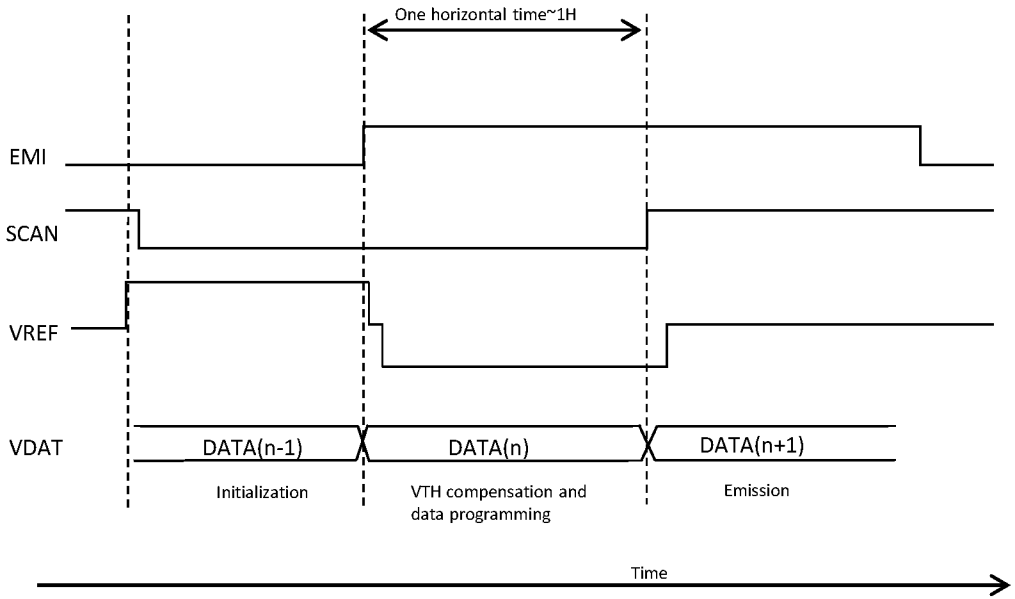
FIG. 2 is a timing diagram associated with the circuit configuration of FIG. 1.

FIG. 1 is a drawing depicting a first circuit configuration 10 in accordance with embodiments of the present invention, and FIG. 2 is a timing diagram associated with the circuit configuration of FIG. 1. In this example, the circuit 10 is configured as a TFT circuit that includes multiple p-type transistors T1-T4 and a single storage capacitor Cst. The circuit elements drive a light-emitting device, such as for example an OLED. The light-emitting device (OLED) has an associated internal capacitance, which is represented in the circuit diagram as $C_{oled}$. In addition, although the embodiments are described principally in connection with an OLED as the light-emitting device, comparable principles may be used with display technologies that employ other types of light-emitting devices, including for example micro LEDs and quantum dot LEDs.

More specifically, FIG. 1 depicts the TFT circuit 10 configured with multiple p-MOS or p-type TFTs. T1 is a drive transistor that is an analogue TFT, and T2-T4 are digital switch TFTs. In this exemplary embodiment, T3 is a double-gate TFT as a preferred embodiment, which have low leakage between source and drain, although T3 alternatively may be a single gate TFT. As referenced above, Cst is a capacitor, and $C_{oled}$ is the internal capacitance of the OLED device (i.e., $C_{oled}$ is not a separate component, but is inherent to the OLED). The OLED further is connected to a first power supply ELVSS as is conventional.

The OLED and the TFT circuit 10, including the transistors, capacitors and connecting wires, may be fabricated using TFT fabrication processes conventional in the art. It will be appreciated that comparable fabrication processes may be employed to fabricate the TFT circuits according to any of the embodiments.

For example, the TFT circuit 10 (and subsequent embodiments) may be disposed on a substrate such as a glass, plastic, or metal substrate. Each TFT may comprise a gate electrode, a gate insulating layer, a semiconducting layer, a first electrode, and a second electrode. The semiconducting layer is disposed on the substrate. The gate insulating layer is disposed on the semiconducting layer, and the gate electrode may be disposed on the insulating layer. The first electrode and second electrode may be disposed on the insulating layer and connected to the semiconducting layer using vias. The first electrode and second electrode respectively may commonly be referred to as the "source electrode" and "drain electrode" of the TFT. The capacitor may comprise a first electrode, an insulating layer and a second electrode, whereby the insulating layer forms an insulating barrier between the first and second electrodes. Wiring between components in the circuit, and wiring used to introduce signals to the circuit (e.g. SCAN, EMI, VDATA, VREF) may comprise metal lines or a doped semiconductor material. For example, metal lines may be disposed between the substrate and the gate electrode of a TFT, and connected to electrodes using vias. The semiconductor layer may be deposited by chemical vapour deposition, and metal layers may be deposited by a thermal evaporation technique.

The OLED device may be disposed over the TFT circuit. The OLED device may comprise a first electrode (e.g. anode of the OLED), which is connected to transistors T1 and T3 in this example, one or more layers for injecting or transporting charge (e.g. holes) to an emission layer, an emission layer, one or more layers for injecting or transporting electrical charge (e.g. electrons) to the emission layer, and a second electrode (e.g. cathode of the OLED), which is connected to first power supply ELVSS in this example. The injection layers, transport layers and emission layer may be organic materials, the first and second electrodes may be metals, and all of these layers may be deposited by a thermal evaporation technique.

Referring to the TFT circuit 10 in combination with the timing diagram in FIG. 2, the TFT circuit 10 operates to perform in three phases: an initialization phase, a combined programming and compensation phase, and an emission phase for light emission. The time period for performing the compensation and programming phase is referred to in the art as the "horizontal time" or "1H" as illustrated in FIG. 2 and subsequent the timing diagrams. A short 1H time is a requirement for displays with a large number of pixels in a column, as is necessary for high-resolution displays. References in the timing diagrams of certain embodiments described below to 2H and 3H refer to multiples of the horizontal time 1H.

In this first embodiment, during the initialization phase, the EMI signal level has a low voltage value, so transistor T4 is on. The SCAN signal level initially has a high voltage value so transistors T2 and T3 are off. As described in detail below, the input voltage VREF can be set to three different values, referred to herein a first or high value, a second or mid value, and a third or low value as indicative of a relative voltage of VREF during different phases of use. At the beginning the initialization phase of FIG. 2, the VREF signal level is changed from the mid value to the high value. As the capacitor (Cst) top plate is floating at this time, the voltage at top plate (node N1), which is the same node as the gate of the drive transistor T1, will be boosted up higher by the amount of the VREF voltage change from mid to high, or $\Delta V_{REF_MH}$ (the "MH" indicates mid to high difference). This change in VREF is selected so as to be sufficient to turn off the current through the drive transistor T1.

Next during the initialization phase, the SCAN signal level is changed from a high voltage value to a low voltage value, causing transistors T2 and T3 to be turned on. As transistor T2 is turned on, the top plate of the storage capacitor, and thus also the gate of the drive transistor (node N1), is connected to a second power supply VDD through transistor T4. The node N1 is initialized to the power supply voltage, VDD. Consequently, the drive transistor T1 is "diode-connected" through transistor T2. Diode-connected refers to the drive transistor T1 being operated with its gate and a second terminal (e.g., source or drain) being connected, such that current flows in one direction. The drive transistor T1, therefore, initially is turned off by the VREF change referenced above and then still is turned off as VDD is applied at the gate of the drive transistor, such that effectively the diode-connected drive transistor is reverse biased. Thus there will be no current through the drive transistor T1 to the OLED.

Once transistor T3 is turned on during the initialization phase, a data voltage VDAT is applied at the anode of the OLED device. Preferably, the VDAT voltage range (i.e. the possible values of VDAT can have) is set such that the voltage across the OLED is entirely lower than the threshold voltage of the OLED, such that there will be no light emission, or light emission will be negligible. As defined herein, a threshold voltage of the OLED is the maximum voltage difference between the anode and cathode of the OLED for which the output luminance of the OLED is less than 1.0%, and preferably less and 0.1%, of the maximum luminance of the OLED during any emission phase of the circuit. VDAT satisfies the condition of being set so that the voltage across the OLED is lower than the OLED threshold voltage for any value within the VDAT voltage range. In exemplary embodiments, when the third transistor is in the on state, the current through the OLED is less than 100 pA. This current level limit may be applicable to any of the embodiments. During the initialization phase, VDAT may have a value corresponding to VDAT for another pixel of the display which is simultaneously in a programming phase, which for example may be the value for the pixel in an adjacent row of the same column of the display, denoted in FIG. 2 as DATA(n−1).

The TFT circuit 10 next is operable in a combined programming and compensation phase, during which the threshold voltage of the drive transistor T1 is compensated and the emission data is programmed. For such phase, the EMI signal level is changed from a low voltage value to a high voltage value, causing transistor T4 to be turned off. The source and gate of the diode-connected transistor T1 and the top plate of the capacitor thus are disconnected from the power supply, VDD, and become floating. The VREF signal level is changed from the high voltage value to the low voltage value, defined herein as a change of $\Delta_{REF}$. Consequently, the voltage at the top plate of the capacitor, and the diode-connected gate and source of the drive transistor, are pulled down by the same amount $\Delta V_{REF}$. This pull down is assumed true to first order; if there are significant parasitic capacitances the change in voltage may not be exactly equal to $\Delta V_{REF}$, but generally the parasitic capacitances are negligible.

Preferably, to have effective voltage threshold compensation of the drive transistor T1, the voltage at the gate of the drive transistor should satisfy the following condition:

$$V_{DAT}-V_{N1}>|V_{TH}|\Delta V,$$

where $V_{N1}$ is the gate voltage of the drive transistor T1; $V_{TH}$ is the threshold voltage of the drive transistor T1, and ΔV is a voltage that is large enough to generate a high initial current to charge the storage capacitor within one horizontal time. The value of ΔV will depend on the properties of the transistors. For example, ΔV would be at least 3 volts for one of low-temperature polycrystalline silicon thin film transistor processes.

The data voltage, VDAT, is changed from the value for another pixel (e.g. the previous row of the display DATA (n−1)) to the data value for the current pixel (e.g. the current row of the display), denoted in FIG. 2 as DATA(n). Consequently, with transistor T3 being on, the voltage at the OLED anode is refreshed to VDAT. As the diode-connected node N1 of the drive transistor T1 is floating and the initial voltage at the node N1 is a low voltage, the voltage at node N1 will be pulled up to the voltage $V_{DAT}+V_{TH}$. At the end of the combined programming and compensation phase, the SCAN signal level is changed from a low voltage value to a high voltage value, causing transistors T2 and T3 to be turned off. As T2 is turned off, the second terminal and gate of the drive transistor T1 are disconnected, and the node N1 becomes floating. The voltage $V_{DAT}+V_{TH}$ is stored at the top plate of the storage capacitor Cst. With T3 turned off, VDAT is disconnected from the anode of the OLED.

The TFT circuit 10 next is operable in an emission phase during which the OLED is capable of emitting light. The VREF voltage is changed from the low voltage value back to the mid value. As the top plate of the capacitor Cst is floating, the voltage at the top plate will raise by the same amount as VREF, $\Delta V_{REF_ML}$ (the ML indicates low to mid difference). With this voltage change, the gate voltage of the drive transistor is adjusted to the operational voltage range of:

$$V_{DAT}+V_{TH}+\Delta V_{REF_ML}$$

The operational range is the gate voltage range of the drive transistor with which the drive transistor can control the amount of current to the light-emitting device from the lowest current to the highest current for the pixel circuits. For example, the current range is from 10 pA to 100 nA in some applications.

Then the EMI signal level is changed from a high value to a low value, causing transistor T4 to be turned on. The source of the drive transistor is connected to the power supply VDD, and the gate voltage of the drive transistor is $V_{DAT}+V_{TH}\ \Delta V_{REF_ML}$. The current to the OLED device is approximately:

$$I_{OLED}=\frac{\beta}{2}(V_{DAT}+V_{TH}+\Delta V_{REF_ML}-V_{DD}-V_{TH})^2=\frac{\beta}{2}(V_{DAT}+\Delta V_{REF_ML}-V_{DD})^2$$

$$\text{where } \beta=\mu_n\cdot C_{ox}\cdot\frac{W}{L},$$

$C_{ox}$ is the capacitance of the drive transistor gate oxide;
W is the width of the drive transistor channel;
L is the length of the drive transistor channel (i.e. distance between source and drain);
$\mu_n$ is the carrier mobility of the drive transistor.

Accordingly, the current to the OLED does not depend on the threshold voltage of the drive transistor T1, and hence the current to the OLED device $I_{OLED}$ is not affected by the threshold voltage variations of the drive transistor. In this manner, variation in the threshold voltage of the drive transistor has been compensated. VDAT then may be set to a data value for a next pixel, denoted in FIG. 2 as DATA (n+1).

Figure 3:
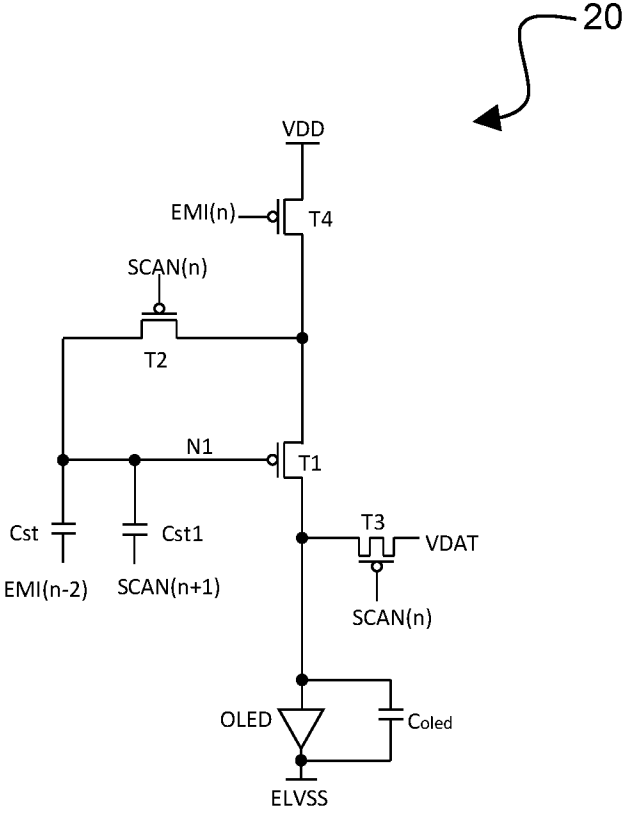
FIG. 3 is a drawing depicting a second circuit configuration in accordance with embodiments of the present invention.
Figure 4:
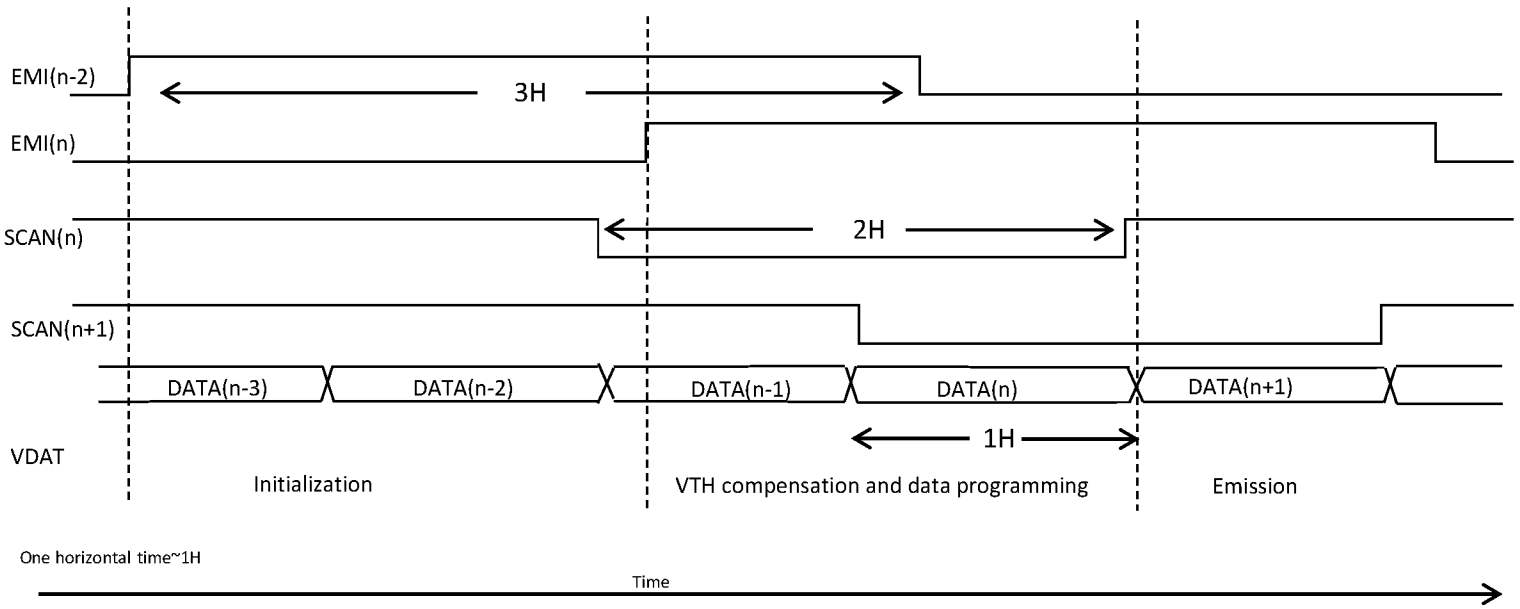
FIG. 4 is a timing diagram associated with the circuit configuration of FIG. 3.

FIG. 3 is a drawing depicting a second circuit configuration 20 in accordance with embodiments of the present invention, and FIG. 4 is a timing diagram associated with the circuit configuration of FIG. 3. In this example, similarly as in the previous embodiment, the circuit 20 is configured as a TFT circuit that includes multiple p-type transistors (T1-T4). In this embodiment, there are two storage capacitors, Cst and Cst1. The circuit elements drive a light-emitting device, such as for example an OLED. The light-emitting device (OLED) has an associated internal capacitance, which is represented in the circuit diagram as $C_{oled}$. Similarly as in the previous embodiment, T1 is a drive transistor that is an analogue TFT, and T2-T4 are digital switch TFTs. In this exemplary embodiment, T3 is a double-gate TFT as a preferred embodiment, although T3 alternatively may be a single gate TFT. $C_{oled}$ is the internal capacitance of the OLED device (i.e., $C_{oled}$ is not a separate component, but is inherent to the OLED). The OLED further is connected to the first power supply ELVSS.

Generally, this embodiment has comparable control signals EMI and SCAN for other rows of pixels in the device, thereby enabling fewer control signal wires in a display configuration. For this example and in subsequent embodiments, display pixels are addressed by row and column. The current row is row n. The previous row is row n−1, and the second previous row is n−2. The next row is row n+1. Accordingly, SCAN(n) refers to the scan signal at row n and SCAN(n+1) refers to the scan signal at row n+1, and the like. EMI(n) refers to the emission signal at row n and EMI(n−2) refers to the emission signal at row n−2, and the like. In manner, for the various embodiments the input signals correspond to the indicated rows. Additionally, in the embodiment of FIG. 3 there is no dedicated VREF signal, which can simplify the driver design as compared to the previous embodiment. Rather, multiple voltage levels are achieved utilizing the two storage capacitors, as detailed below, with EMI and SCAN signals operating as the reference voltage supplies. An optional alternative is to use two reference voltage signal inputs to the storage capacitors in place of the EMI(n−2) and SCAN(n+1) signals, for example, VREF1 and VREF 2. In this embodiment, therefore, the use of two capacitors operate to generate three voltage levels using only two inputs, and a separate logic signal is eliminated. The effect is the same as if multiple reference voltages are provided, which provides a simple and effective configuration.

Referring to the TFT circuit 20 in combination with the timing diagram in FIG. 4, the TFT circuit 20 also operates to perform in three phases: an initialization phase, a combined programming and compensation, and an emission phase for light emission. During the initialization phase, the EMI(n−2) signal level is changed from a low voltage value to a high voltage value. This voltage change is denoted as $\Delta V_{LOGIC}$. As N1 at the top plate of capacitors $C_{st}$ and Cst1 is floating, the voltage at the gate of the drive transistor T1 is boosted up by $$\frac{C_{st}}{C_{st}+C_{st1}}\Delta V_{LOGIC}.$$

Again, this is true to first order; if there are significant parasitic capacitances the change in voltage may not be exactly equal to $$\frac{C_{st}}{C_{st}+C_{st1}}\Delta V_{LOGIC},$$

but preferably the parasitic capacitances are negligible.

Then during the initialization phase, the SCAN(n) signal level is changed from a high voltage value to a low voltage value, causing transistors T2 and T3 to be turned on. As transistor T2 is turned on, the top plate of the storage capacitors (node N1), which is the same node as the gate of the drive transistor T1, is connected to the second power supply, VDD, through transistor T4 and the voltage is initialized to the power supply, VDD. The drive transistor T1 is also diode-connected through transistor T2. With such configuration, any memory effects from the previous frame will be removed from the drive transistor T1 and the storage capacitors $C_{st}$ and $C_{st1}$. With transistor T3 turned on, VDAT is connected to the anode of the OLED. As in the previous embodiment, the VDAT voltage range should meet the condition that threshold voltage of the OLED is not exceeded, such that there will be no light emission, or light emission will be negligible.

The TFT circuit 20 next is operable in a combined programming and compensation phase, during which the threshold voltage of the drive transistor T1 is compensated and the emission data is programmed. During such phase, the EMI(n) signal level is changed from a low voltage value to a high voltage value, causing transistor T4 to be turned off. The node N1 is disconnected from the power supply, VDD, and N1 becomes floating. Then the VDAT signal level is changed from previous row data to current row data. Then the SCAN(n+1) signal level is changed from a high voltage value to a low voltage value. This voltage change is denoted $\Delta V_{LOGIC}$. As the top plate of the capacitor $C_{st1}$ is floating, the voltage at the top plate, the same node as the gate of the drive transistor T1, is pulled down by $$\frac{C_{st1}}{C_{st}+C_{st1}}\Delta V_{LOGIC}.$$

The EMI(n−2) signal level then is changed from a high voltage value to a low voltage value. Similarly, the gate of the drive transistor is pulled down by $$\frac{C_{st}}{C_{st}+C_{st1}}\Delta V_{LOGIC}.$$

The total voltage drop at the gate of the drive transistor T1 will be $\Delta V_{LOGIC}$. Preferably, to have effective voltage threshold compensation, the voltage at the gate of the drive transistor T1 should satisfy the following condition:

$$V_{DAT}-V_{N1}>|V_{TH}|+\Delta V,$$

where $V_{N1}$ is the gate voltage of the drive transistor T1; $V_{TH}$ is the threshold voltage of the drive transistor T1; and ΔV is a voltage that is large enough to generate a high initial current to charge the storage capacitor within one horizontal time. As above, the value of ΔV will depend the properties of the transistors. For example, ΔV would be at least 3 volts for one of low-temperature polycrystalline silicon thin film transistor processes.

As the diode-connected node N1 of the drive transistor T1 is floating and the initial voltage at the node N1 is a low voltage, the voltage at node N1 will be pulled up to the voltage $V_{DAT}+V_{TH}$. At the end of this phase, the SCAN(n) signal level is changed from a low voltage value to a high voltage value, causing transistors T2 and T3 to be turned off. The VDAT is disconnected from the anode of the OLED, and the drive transistor T1 is no longer diode-connected. The voltage $V_{DAT}+V_{TH}$ is stored at the top plates of the capacitors $C_{st}$ and $C_{st1}$.

The TFT circuit 20 next is operable in an emission phase during which the OLED is capable of emitting light. During such phase, the SCAN(n+1) signal level is changed from a low voltage value to a high voltage value. As the top plate of the capacitor $C_{st1}$ is floating, the gate of the drive transistor is boosted by $$\frac{C_{st1}}{C_{st}+C_{st1}}\Delta V_{LOGIC}$$

to the operational voltage range. The EMI(n) signal level then is changed from a high voltage value to a low voltage value, causing transistor T4 to be turned on. The source of the drive transistor is connected to the power supply VDD. The gate voltage of the drive transistor is $$V_{DAT}+V_{TH}+\frac{C_{st1}}{C_{st}+C_{st1}}\Delta V_{LOGIC}.$$

The current to the OLED device is $$I_{OLED}=\frac{\beta}{2}\left(V_{DAT}+V_{TH}+\frac{C_{st1}}{C_{st}+C_{st1}}\Delta V_{LOGIC}-V_{DD}-V_{TH}\right)^2=\frac{\beta}{2}\left(V_{DAT}+\frac{C_{st1}}{C_{st}+C_{st1}}\Delta V_{LOGIC}-V_{DD}\right)^2$$

As in the previous embodiment, the current to the OLED does not depend on the threshold voltage of the drive transistor T1, and hence the current to the OLED device $I_{OLED}$ is not affected by the threshold voltage variations of the drive transistor. In this manner, variation in the threshold voltage of the drive transistor has been compensated. VDAT then may be set to a data value for a next pixel, denoted in FIG. 4 as DATA(n+1).

Figure 5:
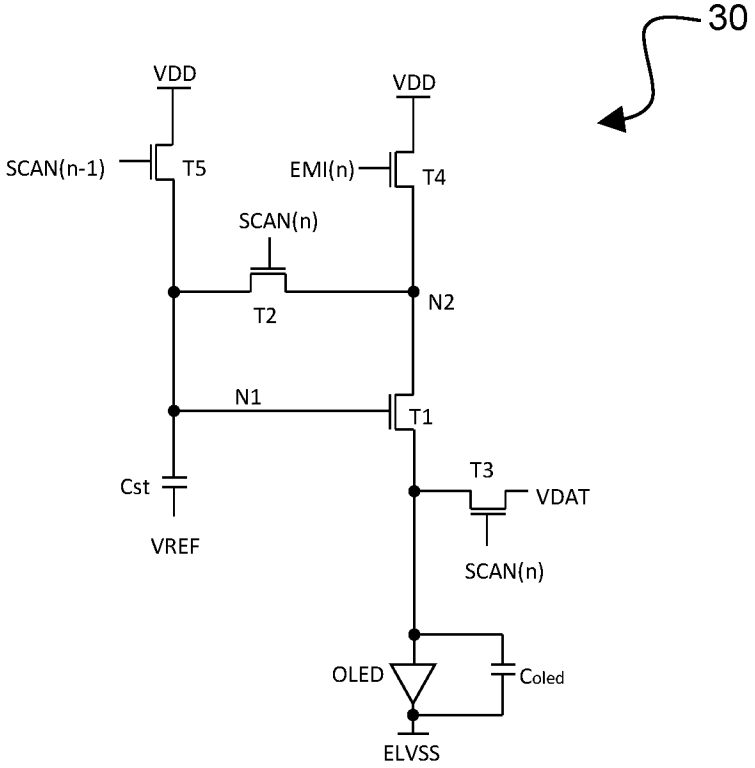
FIG. 5 is a drawing depicting a third circuit configuration in accordance with embodiments of the present invention.
Figure 6:
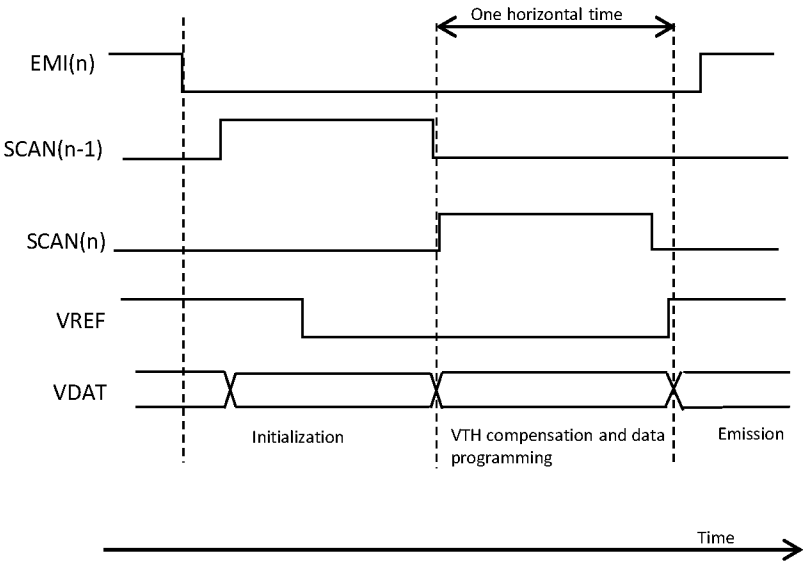
FIG. 6 is a timing diagram associated with the circuit configuration of FIG. 5.

FIG. 5 is a drawing depicting a third circuit configuration 30 in accordance with embodiments of the present invention, and FIG. 6 is a timing diagram associated with the circuit configuration of FIG. 5. In this example, similarly as in the previous embodiments, the circuit 30 is configured as a TFT circuit that includes multiple transistors, which in this embodiment are n-type transistors (T1-T5), and Cst is a capacitor. The circuit elements drive a light-emitting device, such as for example an OLED. The light-emitting device (OLED) has an associated internal capacitance, which is represented in the circuit diagram as $C_{oled}$. T1 is a drive transistor that is an analogue TFT, and T2-T5 are digital switch TFTs, with T5 being an additional transistor in this embodiment. $C_{oled}$ is the internal capacitance of the OLED device (i.e., $C_{oled}$ is not a separate component, but is inherent to the OLED). The OLED further is connected to the first power supply ELVSS.

Generally, this example employs n-type TFTs as referenced above. As further detailed below, the VREF voltage has only two levels in contrast to the first embodiment, and the EMI and SCAN signals are not overlapped. Instead, one more initialization transistor is used (i.e., the total number of transistors is five).

Referring to the TFT circuit 30 in combination with the timing diagram in FIG. 6, the TFT circuit 30 also operates to perform in three phases: an initialization phase, a combined programming and compensation, and an emission phase for light emission. During the initialization phase, the EMI(n) signal level is changed from a high voltage value to a low voltage value, causing transistor T4 to be turned off. The drain of drive transistor T1, node N2, is disconnected from the second power supply, VDD. The SCAN(n−1) signal level is changed from a low voltage value to a high voltage value, causing transistor T5 to be turned on. The top plate of the storage capacitor Cst, node N1, which is the same node as the gate of the drive transistor T1, is connected to the power supply, VDD and the voltage at N1 is initialized to the power supply, VDD. In this manner, any memory effects from the previous frame will be removed from the drive transistor T1 and the storage capacitor Cst. VREF then is changed from a high voltage value to a low voltage value during the period that SCAN(n−1) is at the high voltage value. At the end of the initialization phase, the SCAN(n−1) signal level is changed from a high voltage value to low voltage value, causing transistor T5 to be turned off. The node N1 is thus disconnected from the power supply, VDD.

The TFT circuit 30 next is operable in a combined programming and compensation phase, during which the threshold voltage of the drive transistor T1 is compensated and the emission data is programmed. During such phase, the SCAN (n) signal level is changed from a low voltage value to a high voltage value, causing transistors T3 and T2 to be turned on. The node N1 is connected with the node N2 such that the drive transistor T1 is diode-connected through transistor T2. As transistor T3 is turned on, the data voltage VDAT is applied at the anode of the OLED, and VDAT is changed from previous row data to current row data. The voltage at the OLED anode is thereby refreshed. As VDAT again is smaller than the anode voltage required for emission, there will be either no light emission or the light grayscale is smaller than the programmed light emission grayscale, and therefore negligible. The applied VDAT voltage at the OLED anode accordingly will not degrade the true blackness. As the diode-connected node N1-N2 of the drive transistor is floating, the initial voltage at this node N2-N1 is a positive supply voltage, which is much higher than the threshold voltage of the drive transistor T1 and the VDAT voltage. The voltage at node N2-N1 will drop to the voltage $V_{DAT}+V_{TH}$ at the end of this phase.

Also at the end of this phase, the SCAN(n) signal level is changed from a high voltage value to a low voltage value, causing transistors T3 and T2 to be turned off. The nodes N2 and N1 become disconnected, and the drive transistor T1 is no longer diode-connected. As transistor T3 is turned off, the anode of OLED is disconnected from the VDAT. Then VREF is changed from low to high. The node N1, which is at the gate of the drive transistor T1, is boosted by the VREF voltage level change, ΔVREF. The voltage $V_{DAT}+V_{TH}+$ ΔVREF is stored at the top plate of the capacitor Cst.

The TFT circuit 30 next is operable in an emission phase during which the OLED is capable of emitting light. During such phase, the EMI(n) signal is changed from a low voltage value to a high voltage value, causing transistor T4 to be turned on. The drain of the drive transistor is connected to the power supply, VDD. The gate voltage of the drive transistor T1 is $V_{DAT}+V_{TH}+$ΔVREF. The current to the OLED device is $$I_{OLED} = \frac{\beta}{2}(V_{DAT} + V_{TH} + \Delta VREF - V_{OLED} - V_{TH})^2 = \frac{\beta}{2}(V_{DAT} + \Delta VREF - V_{OLED})^2$$

As in the previous embodiments, the current to the OLED does not depend on the threshold voltage of the drive transistor T1, and hence the current to the OLED device $I_{OLED}$ is not affected by the threshold voltage variations of the drive transistor. In this manner, variation in the threshold voltage of the drive transistor has been compensated. VDAT then may be set to a data value for a next pixel.

Figure 7:
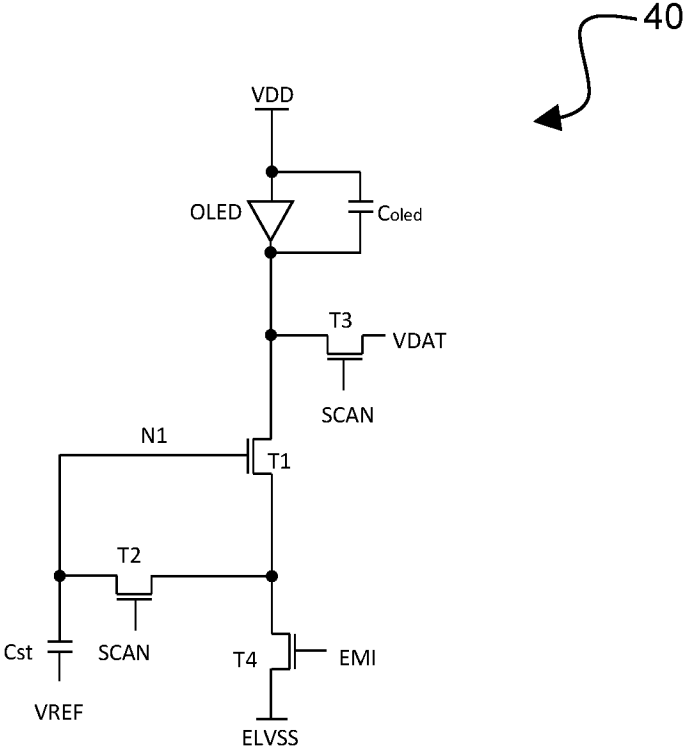
FIG. 7 is a drawing depicting a fourth circuit configuration in accordance with embodiments of the present invention.
Figure 8:
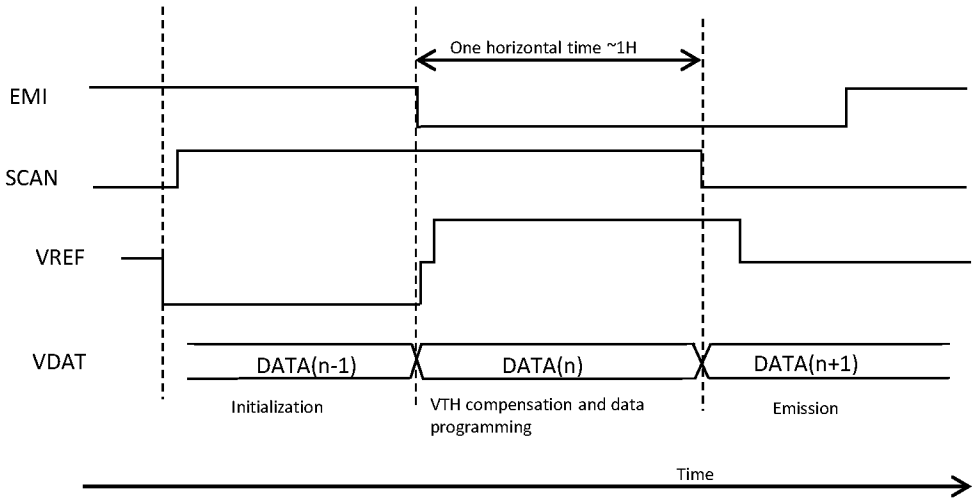
FIG. 8 is a timing diagram associated with the circuit configuration of FIG. 7.

FIG. 7 is a drawing depicting a fourth circuit configuration 40 in accordance with embodiments of the present invention, and FIG. 8 is a timing diagram associated with the circuit configuration of FIG. 7. The embodiment of FIG. 7 operates similarly as the embodiment of FIG. 1, except that the OLED is connected in an "inverted" configuration by which the OLED is connected to the pixel circuit through the cathode. This embodiment further employs n-type TFTs, and the programmed current does not depend on the voltage across OLED.

In this example, similarly as in the previous embodiments, the circuit 40 is configured as a TFT circuit that includes multiple transistors (T1-T4), and a storage capacitor, Cst. The circuit elements drive a light-emitting device, such as for example an OLED. The light-emitting device (OLED) has an associated internal capacitance, which is represented in the circuit diagram as $C_{oled}$. Similarly as in the previous embodiments, T1 is a drive transistor that is an analogue TFT, and T2-T4 are digital switch TFTs. $C_{oled}$ is the internal capacitance of the OLED device (i.e., $C_{oled}$ is not a separate component, but is inherent to the OLED). With the inverted configuration, the OLED further is connected to the second power supply VDD at the OLED anode.

Referring to the TFT circuit 40 in combination with the timing diagram in FIG. 8, the TFT circuit 40 also operates to perform in three phases: an initialization phase, a combined programming and compensation, and an emission phase for light emission. During the initialization phase, the EMI signal level has a high voltage value, so transistor T4 is on. The SCAN signal level has a low voltage value so transistors T2 and T3 are off. The VREF signal level is changed from a mid value to a low value. As the capacitor Cst top plate is floating, the voltage at top plate, node N1, which is the same node as the gate of the drive transistor T1, will be pulled down lower by the amount of the VREF voltage change, $\Delta V_{REF_ML}$, which turns off the current through the drive transistor T1.

Next, the SCAN signal level is changed from a low voltage value to a high voltage value, causing transistors T2 and T3 to be turned on. As transistor T2 is turned on, the top plate of the storage capacitor, and also the gate of the drive transistor (node N1), is connected to the first power supply ELVSS through transistor T4. The node N1 is initialized to the power supply voltage, ELVSS. Consequently, the drive transistor T1 is diode-connected and turned off for initialization, and there will be no current through the drive transistor T1 to the OLED. Once transistor T3 is turned on, the data voltage VDAT is applied at the cathode of the OLED device. Preferably, the VDD-VDAT voltage range (i.e. based on the possible values that VDAT can have) satisfies the condition that the voltage across the OLED remains lower than the threshold voltage of the OLED, such that there will be no light emission, or light emission will be negligible.

The TFT circuit 40 next is operable in a combined programming and compensation phase, during which the threshold voltage of the drive transistor T1 is compensated and the emission data is programmed. During such phase, the EMI signal level is changed from a high voltage value to a low voltage value, causing transistor T4 to be turned off. The source and gate of the diode-connected transistor T1 and the top plate of the capacitor are disconnected from the power supply, ELVSS, and become floating. The VREF signal level is changed from a low voltage value to a high voltage value, denoted as a change of $\Delta V_{REF}$. Consequently, the voltage at the top plate of the capacitor, and the diode-connected gate and second terminal of the drive transistor, are boosted up by the same amount $\Delta V_{REF}$ (again with parasitic capacitances presumed negligible). To have effective threshold compensation, the voltage at the gate of the drive transistor should satisfy the following condition:

$$V_{N1} - V_{DAT} > |V_{TH}| + \Delta V,$$

where $V_{N1}$ is the gate voltage of the drive transistor T1; $V_{TH}$ is the threshold voltage of the drive transistor T1; and $\Delta V$ is a voltage that is large enough to generate a high initial current to charge the storage capacitor within one horizontal time. As referenced above, the value of $\Delta V$ will depend on the properties of the transistors. For example, $\Delta V$ would be at least 3 volts for one of low-temperature polycrystalline silicon thin film transistor processes.

The data voltage, VDAT, then is changed from the value for the previous row data to the value for the current row data. Consequently, the voltage at the OLED cathode is refreshed to VDAT. As the diode-connected node of the drive transistor T1 is floating and the initial voltage at the node N1 is a high voltage, the voltage at node N1 will be pulled down to the voltage $V_{DAT}+V_{TH}$. At the end of this phase, the SCAN signal level is changed from a high voltage value to a low voltage value, causing transistors T2 and T3 to be turned off. As T2 is turned off, the source and gate of the drive transistor T1 are disconnected, and the node N1 becomes floating. The voltage $V_{DAT}+V_{TH}$ is stored at the top plate of the capacitor Cst. With T3 turned off, VDAT is disconnected from the cathode of the OLED.

The TFT circuit 40 next is operable in an emission phase during which the OLED is capable of emitting light. During such phase, the VREF voltage is changed from a high voltage value to a mid value. As the top plate of the capacitor Cst is floating, the voltage at the top plate will drop by the same amount as VREF, $\Delta V_{REF_MH}$. With this voltage change, the gate voltage of the drive transistor is adjusted to the operational voltage range.

$$V_{DAT}+V_{TH}-\Delta V_{REF_MH}$$

Then EMI signal level is changed from a low voltage value to a high voltage value, causing transistor T4 to be turned on. The source of the drive transistor is connected to the power supply ELVSS. The gate voltage of the drive transistor is $V_{DAT}+V_{TH}-\Delta V_{REF_MH}$. The current to the OLED device is approximately:

$$I_{OLED} = \frac{\beta}{2}(V_{DAT} + V_{TH} - \Delta V_{\mathrm{REF_MH}} - V_{ELVSS} - V_{TH})^2 = \frac{\beta}{2}(V_{DAT} - \Delta V_{\mathrm{REF_MH}} - V_{ELVSS})^2$$

$$\text{where } \beta = \mu_n \cdot C_{ox} \cdot \frac{w}{L},$$

$C_{ox}$ is the capacitance of the drive transisto gate oxide;

W is the width of the drive transistor channel;

L is the length of the drive transistor channel (i.e. distance between source and drain);

$\mu_n$ is the carrier mobility of the transistor.

As in the previous embodiments, the current to the OLED does not depend on the threshold voltage of the drive transistor T1, and hence the current to the OLED device $I_{OLED}$ is not affected by the threshold voltage variations of the drive transistor. In this manner, variation in the threshold voltage of the drive transistor has been compensated. VDAT then may be set to a data value for a next pixel.

Figure 9:
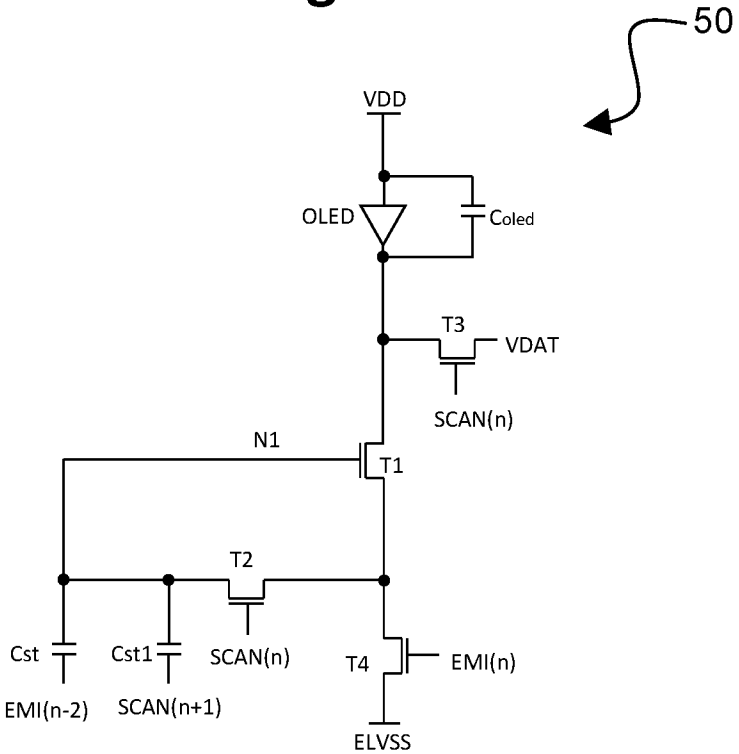
FIG. 9 is a drawing depicting a fifth circuit configuration in accordance with embodiments of the present invention
Figure 10:
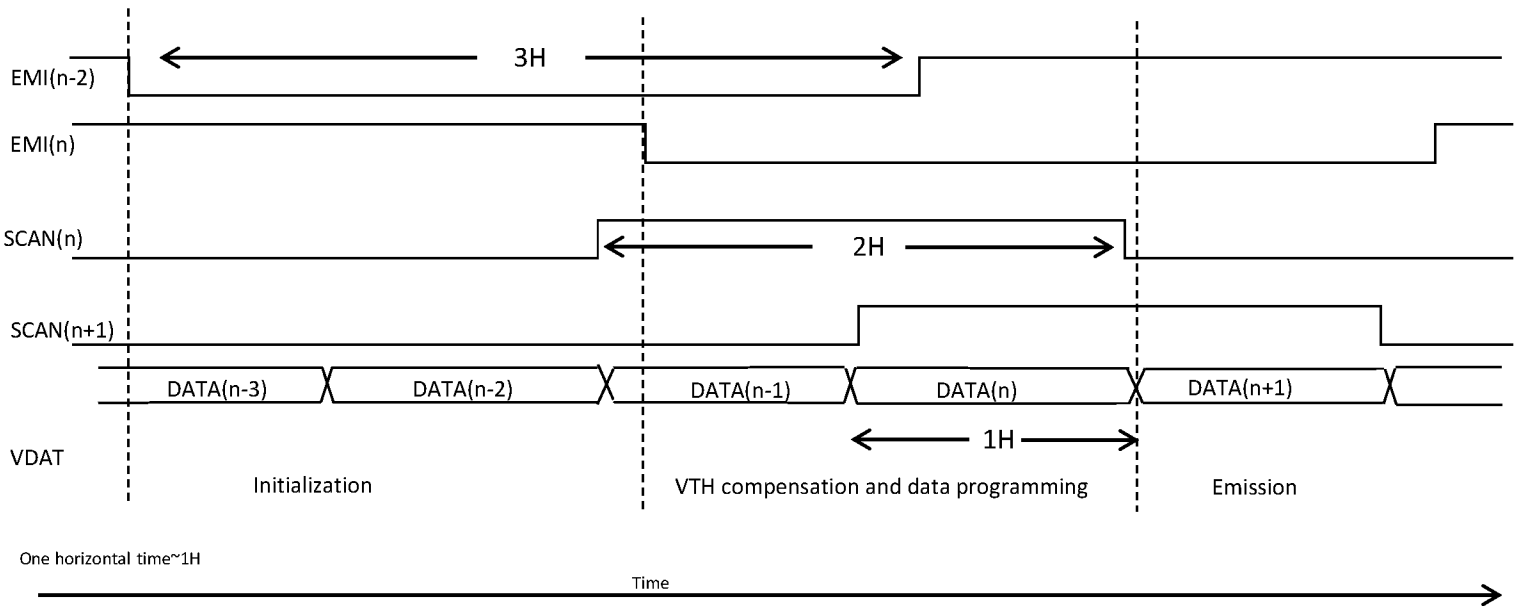
FIG. 10 is a timing diagram associated with the circuit configuration of FIG. 9.

FIG. 9 is a drawing depicting a fifth circuit configuration 50 in accordance with embodiments of the present invention, and FIG. 10 is a timing diagram associated with the circuit configuration of FIG. 9. The embodiment of FIG. 9 operates similarly as the embodiment of FIG. 3, except the OLED is connected in the "inverted" configuration (like FIG. 7) by which the OLED is connected to the pixel circuit through the cathode. This embodiment further employs n-type TFTs, and the programmed current does not depend on the voltage across the OLED.

In this example, similarly as in previous embodiments, the circuit 50 is configured as a TFT circuit that includes multiple transistors (T1-T4). In this embodiment, there are the two capacitors, Cst and Cst1 comparably as in the circuit of FIG. 3. The circuit elements drive a light-emitting device, such as for example an OLED. The light-emitting device (OLED) has an associated internal capacitance, which is represented in the circuit diagram as $C_{oled}$. Similarly as in the previous embodiments, T1 is a drive transistor that is an analogue TFT, and T2-T4 are digital switch TFTs. $C_{oled}$ is the internal capacitance of the OLED device (i.e., $C_{oled}$ is not a separate component, but is inherent to the OLED). In the inverted configuration, the OLED further is connected at its anode to the second power supply VDD.

Similarly as in the embodiment of FIG. 3, this embodiment has comparable control signals EMI and SCAN for other rows of pixels in the device, thereby enabling fewer control signal wires in a display configuration. Additionally, there is no dedicated VREF signal, which can simplify the driver design compared to the previous embodiment, and rather EMI and SCAN signal effectively are used as reference voltage signals. An optional alternative is to use two reference voltage signal inputs to the capacitors in place of the EMI(n−2) and SCAN(n+1); for example, VREF1 and VREF 2. In this embodiment, therefore, the use of the two capacitors operates to generate three voltage levels using only two inputs, and a separate logic signal is eliminated. The effect is the same as if multiple reference voltages are provided, which provides a simple and effective configuration.

Referring to the TFT circuit 50 in combination with the timing diagram in FIG. 10, the TFT circuit 50 also operates to perform in three phases: an initialization phase, a combined programming and compensation, and an emission phase for light emission. During the initialization phase, EMI(n−2) signal level is changed from a high voltage value to a low voltage value. The voltage change is denoted $\Delta V_{LOGIC}$. As the top plate of capacitor $C_{st}$ is floating, the voltage at the top plate or the gate of the drive transistor T1 is pulled down by $$\frac{C_{st}}{C_{st}+C_{st1}}\Delta V_{LOGIC}$$

(again assuming true to first order with negligible parasitic capacitance). Then SCAN(n) signal level is changed from low to high, causing transistors T2 and T3 to be turned on. As transistor T2 is turned on, the top plate of the storage capacitors at node N1, which is the same node as the gate of the drive transistor T1, is connected to the first power supply, ELVSS, through transistor T4 and the voltage is initialized to the power supply, ELVSS. The drive transistor T1 is also diode-connected through transistor T2. Any memory effects from the previous frame will be removed from the drive transistor T1 and the storage capacitors $C_{st}$ and $C_{st1}$. As transistor T3 is turned on, VDAT is connected to the cathode of the OLED. The VDD-VDAT voltage range (i.e. based on the possible values of VDAT can have) satisfies the condition that the voltage across the OLED remains lower than the threshold voltage of the OLED, such that there will be no light emission, or light emission will be negligible.

The TFT circuit 50 next is operable in a combined programming and compensation phase, during which the threshold voltage of the drive transistor T1 is compensated and the emission data is programmed. During such phase, the EMI(n) signal level is changed from a high voltage value to a low voltage value, causing transistor T4 to be turned off. The node N1 is disconnected from the power supply, ELVSS, and N1 becomes floating. Then the VDAT signal level is changed from previous row data to current row data. The SCAN(n+1) signal level then is changed from a low voltage value to a high voltage value. This voltage change is denoted $\Delta V_{LOGIC}$. As the top plate of the capacitor $C_{st1}$ is floating, the voltage at the top plate, which is the same node as the gate of the drive transistor T1, is boosted up by $$\frac{C_{st1}}{C_{st}+C_{st1}}\Delta V_{LOGIC}.$$

The EMI(n−2) signal level then is changed from a low value to a high value. Similarly, the gate of the drive transistor T1 is boosted up by $$\frac{C_{st}}{C_{st}+C_{st1}}\Delta V_{LOGIC}.$$

The total voltage change at the gate of the drive transistor will be $\Delta V_{LOGIC}$.

To have effective threshold compensation, the voltage at the gate of the drive transistor should satisfy the following condition:

$$V_{N1}-V_{DAT}>|V_{TH}|+\Delta V,$$

where $V_{N1}$ is the gate voltage of the drive transistor T1; $V_{TH}$ is the threshold voltage of the drive transistor T1; and ΔV is a voltage that is large enough to generate a high initial current to charge the storage capacitor within one horizontal time. As referenced previously, the value of ΔV will depend the properties of the transistors. For example, ΔV would be at least 3 volts for one of low-temperature polycrystalline silicon thin film transistor processes. As the diode-connected node of the drive transistor T1 is floating and the initial voltage at the node N1 is a high voltage, the voltage at node N1 will be pulled down to the voltage $V_{DAT}+V_{TH}$. At the end of this phase, the SCAN(n) signal level is changed from a high voltage value to a low voltage value, causing transistor T2 and T3 to be turned off. The VDAT is disconnected from the cathode of the OLED, and the drive transistor T1 is no longer diode-connected. The voltage $V_{DAT}+V_{TH}$ is stored at the top plates of the capacitors $C_{st}$ and $C_{st1}$.

The TFT circuit 50 next is operable in an emission phase during which the OLED is capable of emitting light. During such phase, the SCAN(n+1) signal level is changed from a high voltage value to a low voltage value. As the top plate of the capacitor $C_{st1}$ is floating, the gate of the drive transistor is pulled down by $$\frac{C_{st1}}{C_{st}+C_{st1}}\Delta V_{LOGIC}$$

to the operational voltage range. The EMI(n) signal level then is changed from a low voltage value to a high voltage value, causing transistor T4 to be turned on. The source of the drive transistor is connected to the power supply ELVSS. The gate voltage of the drive transistor is $$V_{DAT}+V_{TH}-\frac{C_{st1}}{C_{st}+C_{st1}}\Delta V_{LOGIC}.$$

The current to the OLED device is $$I_{OLED}=\frac{\beta}{2}\left(V_{DAT}+V_{TH}-\frac{C_{st1}}{C_{st}+C_{st1}}\Delta V_{LOGIC}-V_{ELVSS}-V_{TH}\right)^2=\frac{\beta}{2}\left(V_{DAT}-\frac{C_{st1}}{C_{st}+C_{st1}}\Delta V_{LOGIC}-V_{ELVSS}\right)^2$$

where $\beta=\mu_n\cdot C_{ox}\cdot\frac{w}{L}$, $C_{ox}$ is the capacitance of the drive transistor gate oxide;
W is the width of the drive transistor channel;
L is the length of the drive transistor channel (i.e. distance between source and drain);
$\mu_n$ is the carrier mobility of the transistor.

As in the previous embodiments, the current to the OLED does not depend on the threshold voltage of the drive transistor T1, and hence the current to the OLED device $I_{OLED}$ is not affected by the threshold voltage variations of the drive transistor. In this manner, variation in the threshold voltage of the drive transistor has been compensated. VDAT then may be set to a data value for a next pixel.

The described pixel circuits have advantages over conventional configurations. Such circuit configurations are capable of compensating the threshold voltage variations with fewer transistors than in conventional configurations, with additionally removing the possible memory effects associated with the OLED device and drive transistor from the previous frame. The described circuit configurations, therefore, improve the capability of a pixel to emit very little or no light and therefore have a true black state. The advantages, therefore, include providing effective threshold voltage compensation, reduction or elimination of memory effects, and true black improvements with efficient data programming.

The various embodiments have been described in connection with OLEDs as the display light-emitting device. The circuit configurations, however, are not limited to any particular display technology. For example, the circuit configurations also may also be used for micro LED displays, quantum dot LED displays, or any other device which emits light in response to an applied electrical bias. A micro LED, for example, is a semiconductor device containing a p-type region, an n-type region and a light emission region, for example formed on a substrate and divided into individual chips. A micro LED may be based on a III-nitride semiconductor. A quantum dot LED, for example, is a device containing a hole transport layer, an electron transport layer, and a light emission region, wherein the light emission regions contains nanocrystalline quantum dots. The circuit configurations, described herein may be employed for any such display technologies.

An aspect of the invention is a pixel circuit for a display device that is operable an initialization state, in a combined programming and compensation phase, and in an emission phase. In exemplary embodiments, the pixel circuit includes: a drive transistor configured to control an amount of current to a light-emitting device depending upon a voltage applied to a gate of the drive transistor; a second transistor connected to the gate of the drive transistor and a second terminal of the drive transistor, such that when the second transistor is in an on state the drive transistor becomes diode-connected such that the gate and the second terminal of the drive transistor are connected through the second transistor; a light-emitting device that is connected at a first node to a third terminal of the drive transistor and at a second node to a first voltage supply; a third transistor connected to the first node of the light-emitting device, which connects a data voltage to the first node of the light-emitting device; a fourth transistor that is connected between the second terminal of the drive transistor and a second voltage supply; and at least one capacitor having a first plate that is connected to the gate of the drive transistor and a second plate that is connectable to a reference signal. The pixel circuit may include one or more of the following features, either individually or in combination.

In an exemplary embodiment of the pixel circuit, the at least one capacitor comprises a plurality of capacitors each having a first plate that is connected to the gate of the drive transistor and a second plate that is connectable to a respective reference signals.

In an exemplary embodiment of the pixel circuit, the first through fourth transistors are p-type transistors.

In an exemplary embodiment of the pixel circuit, the first node of the light-emitting device is an anode and the second node of the light emitting device is a cathode.

In an exemplary embodiment of the pixel circuit, the first through fourth transistors are n-type transistors.

In an exemplary embodiment of the pixel circuit, the pixel circuit further includes a fifth transistor that is connected between the second transistor and the second voltage supply.

In an exemplary embodiment of the pixel circuit, the first node of the light-emitting device is a cathode and the second node of the light emitting device is an anode.

In an exemplary embodiment of the pixel circuit, the light-emitting device is an organic light-emitting diode, a micro light-emitting diode (LED), or a quantum dot LED.

Another aspect of the invention is a method of operating a pixel circuit by which the pixel circuit is operable during a phase preceding the emission phase, during which the drive transistor is diode connected. The phase preceding the emission phase includes applying a data voltage to the first node of the light-emitting device and the third terminal of the drive transistor, the data voltage being set so that a voltage across the light-emitting device is lower than a threshold voltage of the light emitting device. The operating method may include one or more of the following features, either individually or in combination.

The operating method may include applying a reference signal to the second plate of the capacitor, wherein the reference signal is connected to a reference power supply; changing the reference signal to a level for compensation for variations of a threshold voltage of the drive transistor; and during a subsequent emission phase, adjusting the reference signal to change the gate voltage of the drive transistor to the operational voltage range, in which the drive transistor controls the amount of current to the light-emitting device The operating method may include performing an initialization phase, performing a combined programming and compensation phase; and performing the emission phase. In exemplary embodiments, each phase may include the following. During the initialization phase, memory effects from previous frames are reduced by performing the steps of: keeping the fourth transistor in the on state and keeping the second and third transistors in an off state; inputting the reference signal, wherein the reference signal during the initialization phase is set at a level corresponding to the drive transistor being in an off state; switching the second and third transistors from the off state to the on state, wherein the drive transistor becomes diode-connected through the second transistor and thereby connecting the gate of the drive transistor to the second voltage; and applying a data voltage VDAT to the first terminal of the light-emitting device, VDAT being set so that the voltage across the light-emitting device is lower than a threshold voltage. During the combined programming and compensation phase, the voltage threshold of the drive transistor is at least partially compensated and data is programmed by the steps of: placing the fourth transistor in an off state; changing the reference signal to a level for compensation for variations of a threshold voltage of the drive transistor; and updating VDAT to a data voltage for a current pixel. During the emission phase, light output is controlled by performing the steps of: placing the second and third transistors in an off state; adjusting the reference signal to change the gate voltage of the drive transistor to the operational voltage range, in which the drive transistor controls the amount of current to the light-emitting device; placing the fourth transistor in the on state to connect the second power supply to the drive transistor; and controlling an amount of current to the light-emitting device depending upon a voltage applied to a gate of a drive transistor.

In an exemplary embodiment of the operating method, the threshold voltage of the light-emitting device is the maximum voltage difference between the anode and cathode of the OLED for which the output luminance of the OLED is less than 1.0% of the maximum luminance of the OLED during any emission phase.

In an exemplary embodiment of the operating method, the at least one capacitor comprises a single capacitor that is connected to a multi-level reference voltage VREF as the reference signal.

In an exemplary embodiment of the operating method, the at least one capacitor comprises first and second capacitors each having a first plate that is connected to the gate of the drive transistor and a second plate that is connected to a respective reference signal.

In an exemplary embodiment of the operating method, the second plate of the first capacitor is connected to a SCAN signal and the second plate of the second capacitor is connected to an EMI signal as the reference signals.

In an exemplary embodiment of the operating method, the data voltage is applied to an anode of the light-emitting device.

In an exemplary embodiment of the operating method, the data voltage is applied to a cathode of the light-emitting device.

In an exemplary embodiment of the operating method, the pixel circuit further comprises a fifth transistor that is connected between the second transistor and the second voltage supply, and the fifth transistor is turned on to connect the top plate of the capacitor to the second voltage supply.

In an exemplary embodiment of the operating method, the light-emitting device is one of an organic light-emitting diode, a micro light-emitting diode (LED), or a quantum dot LED.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

INDUSTRIAL APPLICABILITY

Embodiments of the present invention are applicable to many display devices to permit display devices of high resolution with effective threshold voltage and true black performance. Examples of such devices include televisions, mobile phones, personal digital assistants (PDAs), tablet and laptop computers, desktop monitors, digital cameras, and like devices for which a high resolution display is desirable.

REFERENCE SIGNS LIST

10—first circuit configuration
20—second circuit configuration
30—third circuit configuration
40—fourth circuit configuration
50—fifth circuit configuration
T1-T5—multiple transistors
OLED—organic light emitting diode (or generally light-emitting device)
Cst/Cst1—storage capacitors
$C_{oled}$—internal capacitance of OLED
N1—Node at drive transistor
VDAT—data voltage
VDD—power supply
ELVSS—power supply
VREF—reference voltage supply
SCAN/EMI—control signals

What is claimed is:

1. A pixel circuit for a display device comprising:

a drive transistor configured to control an amount of current to a light-emitting device depending upon a voltage applied to a gate of the drive transistor;

a second transistor connected to the gate of the drive transistor and a second terminal of the drive transistor, such that when the second transistor is in an on state the drive transistor becomes diode-connected such that the gate and the second terminal of the drive transistor are connected through the second transistor;

a light-emitting device that is connected at a first node to a third terminal of the drive transistor and at a second node to a first voltage supply;

a third transistor directly connected to the first node of the light-emitting device and directly connected to a data voltage supply line, which connects a data voltage to the first node of the light-emitting device;

a fourth transistor that is connected between the second terminal of the drive transistor and a second voltage supply; and at least one capacitor having a first plate that is directly connected to the gate of the drive transistor and a second plate that is directly connected to a reference voltage supply line for supplying a reference signal.

2. The pixel circuit of claim 1, wherein the at least one capacitor comprises a plurality of capacitors each having a first plate that is connected to the gate of the drive transistor and a second plate that is connectable to a respective reference signals.

3. The pixel circuit of claim 1, wherein the first through fourth transistors are p-type transistors.

4. The pixel circuit of claim 1, wherein the first node of the light-emitting device is an anode and the second node of the light emitting device is a cathode.

5. The pixel circuit of claim 1, wherein the first through fourth transistors are n-type transistors.

6. The pixel circuit of claim 5, further comprising a fifth transistor that is connected between the second transistor and the second voltage supply.

7. The pixel circuit of claim 5, wherein the first node of the light-emitting device is a cathode and the second node of the light emitting device is an anode.

8. The pixel circuit of claim 1, wherein the light-emitting device is an organic light-emitting diode, a micro light-emitting diode (LED), or a quantum dot LED.

9. The pixel circuit of claim 1, wherein the reference signal has a first value and a second value, and the first value changes to the second value during an initialization phase and a programming phase.

10. A method of operating a pixel circuit for a display device comprising the steps of:

providing a pixel circuit comprising:

a drive transistor configured to control an amount of current to a light-emitting device depending upon a voltage applied to a gate of the drive transistor; and a light-emitting device that is connected at a first node to a third terminal of the drive transistor and at a second node to a first voltage supply; and a capacitor having a first plate that is connected to the gate of the drive transistor and a second plate that is connectable to a reference signal;

during a phase preceding the emission phase, the second transistor is diode connected, and the phase preceding the emission phase includes applying a data voltage to the first node of the light-emitting device and the second terminal of the drive transistor, the data voltage being set so that a voltage across the light-emitting device is lower than a threshold voltage of the light emitting device;

applying the reference signal to the second plate of the capacitor, wherein the reference signal is connected to a reference power supply; and changing the reference signal to a level for compensation for variations of a threshold voltage of the drive transistor.

11. The operating method of claim 10, further comprising during a subsequent emission phase, adjusting the reference signal to turn on the drive transistor.

12. The operating method claim 10, wherein a threshold voltage of the light-emitting device is the maximum voltage difference between an anode and cathode of the OLED for which the output of the OLED is less than 1.0% of maximum time-integrated luminance during a frame.

13. The operating method of claim 10, wherein the data voltage is applied to an anode of the light-emitting device.

14. The operating method of claim 10, wherein the data voltage is applied to a cathode of the light-emitting device.

15. The operating method claim 10, wherein the pixel circuit further comprises a fifth transistor that is connected between the second transistor and the second voltage supply, and the fifth transistor is turned on to connect the top plate of the capacitor to the second voltage supply.

16. The operating method of claim 10, wherein the light-emitting device is one of an organic light-emitting diode, a micro light-emitting diode (LED), or a quantum dot LED.

17. A method of operating a pixel circuit for a display device comprising the steps of:

providing a pixel circuit comprising:

a drive transistor configured to control an amount of current to a light-emitting device depending upon a voltage applied to a gate of the drive transistor; and a light-emitting device that is connected at a first node to a third terminal of the drive transistor and at a second node to a first voltage supply;

during a phase preceding the emission phase, the second transistor is diode connected, and the phase preceding the emission phase includes applying a data voltage to the first node of the light-emitting device and the second terminal of the drive transistor, the data voltage being set so that a voltage across the light-emitting device is lower than a threshold voltage of the light emitting device;

wherein the pixel circuit is operable in an initialization phase, a combined programming and compensation phase, and in the emission phase;

wherein the pixel circuit further comprises:

a second transistor connected to the gate of the drive transistor and a second terminal of the drive transistor, such that when the second transistor is in an on state the drive transistor becomes diode-connected such that the gate and the second terminal of the drive transistor are connected through the second transistor;

a third transistor connected to the first node of the light-emitting device, which connects a data voltage to the first node of the light-emitting device;

a fourth transistor that is connected between the second terminal of the drive transistor and a second voltage supply; and at least one capacitor having a first plate that is connected to the gate of the drive transistor and a second plate that is connectable to a reference signal;

the operating method comprising the steps of:

during the initialization phase, reducing memory effects from previous frames by performing the steps of:

keeping the fourth transistor in the on state and keeping the second and third transistors in an off state;

inputting the reference signal wherein the reference signal during the initialization phase is set at a level corresponding to the drive transistor being in an off state;

switching the second and third transistors from the off state to the on state, wherein the drive transistor becomes diode-connected through the second transistor, thereby connecting the gate of the drive transistor to the second voltage supply; and applying a data voltage VDAT to the first terminal of the light-emitting device, VDAT being set so that the voltage across the light-emitting device is lower than a threshold voltage;

during the combined programming and compensation phase, at least partially compensating a threshold voltage of the drive transistor by the steps of:

placing the fourth transistor in an off state;

changing the reference signal to a level for compensation for variations of a threshold voltage of the drive transistor; and updating VDAT to a data voltage for a current pixel;

and during the emission phase, performing the steps of:

placing the second and third transistors in an off state;

adjusting the reference signal to turn on the drive transistor;

placing the fourth transistor in the on state to connect the second power supply to the drive transistor; and controlling an amount of current to the light-emitting device depending upon a voltage applied to a gate of a drive transistor.

18. The operating method of claim 17, wherein the at least one capacitor comprises a single capacitor that is connected to a multi-level reference voltage VREF as the reference signal.

19. The operating method claim 17, wherein the at least one capacitor comprises first and second capacitors each having a first plate that is connected to the gate of the drive transistor and a second plate that is connected to a respective reference signal.

20. The operating method of claim 19, wherein the second plate of the first capacitor is connected to a SCAN signal and the second plate of the second capacitor is connected to an EMI signal as the reference signals.

* * * * *